US005879408A

United States Patent [19]

Kubo et al.

[11] Patent Number: 5,879,408

[45] Date of Patent: Mar. 9, 1999

[54] METHOD OF STAINPROOFING CELLULOSE FIBERS AND STAINPROOFED PRODUCT

[75] Inventors: Motonobu Kubo; Takashi Enomoto, both of Osaka, Japan

[73] Assignee: Daikin Industries Ltd., Osaka, Japan

[21] Appl. No.: 849,842

[22] PCT Filed: Dec. 14, 1995

[86] PCT No.: PCT/JP95/02559

§ 371 Date: Jun. 12, 1997

§ 102(e) Date: Jun. 12, 1997

[87] PCT Pub. No.: WO96/18764

PCT Pub. Date: Jun. 20, 1996

[30] Foreign Application Priority Data

Dec. 15, 1994 [JP] Japan ..... 6-311635

[51] Int. Cl.[6] ..... D06M 13/188; D06M 15/277

[52] U.S. Cl. ..... 8/120; 8/121; 8/116.1; 427/389.9; 427/391; 427/392; 427/394; 427/393.4; 427/395; 427/396; 442/94; 442/95; 428/364; 428/365

[58] Field of Search ..... 8/120, 121, 116.1; 427/389.9, 391, 392, 394, 395, 396, 393.4; 442/94, 95; 428/364, 365

[56] References Cited

U.S. PATENT DOCUMENTS

| | | | |
|---|---|---|---|
| 1,861,320 | 5/1932 | Rheiner | 8/121 |
| 3,574,791 | 4/1971 | Sherman et al. . | |
| 3,919,183 | 11/1975 | Jager et al. | 526/245 |

FOREIGN PATENT DOCUMENTS

| | | |
|---|---|---|
| 02277887 | 11/1990 | Japan . |
| 04068006 | 3/1992 | Japan . |
| 06116340 | 4/1994 | Japan . |
| 5235033 | 9/1997 | Japan . |

OTHER PUBLICATIONS

A.J. Hall, "The Standard Handbook of Textiles," pp. 43–53, (month unknown), 1975.

A.J. Hall, "The Standard Handbook of Textiles," pp. 49–50, (month unknown), 1975.

*Primary Examiner*—Alan Diamond

*Attorney, Agent, or Firm*—Birch, Stewart, Kolasch & Birch, LLP

[57] ABSTRACT

Stainproofing properties are imparted to a cellulose fiber by 1) esterifying a part of hydroxyl groups of the cellulose fiber in a heterogeneous reaction system and 2) subjecting the partially esterified cellulose fiber to a stainproofing treatment with an aqueous solution or emulsion of a copolymer having repeating units derived from a fluroalkyl group-containing polymerizable compound and a compound represented by the general formula:

$$CH_2{=}CR^1COO{-}(XO)_m{-}(YO)_n{-}R^2 \quad (1)$$

wherein X is $-CH(CH_3)-CH_2-$ or $-CH_2-CH(CH_3)-$; Y is $-CH_2CH_2-$; $R^1$ is a hydrogen atom or a methyl group; $R^2$ is a hydrogen atom or an alkyl group having 1 to 8 carbon atoms; and each of m and n is an integer of 0 to 50, provided that the total of m and n is an integer of 1 to 70.

14 Claims, No Drawings

METHOD OF STAINPROOFING CELLULOSE FIBERS AND STAINPROOFED PRODUCT

This application is a 371 of PCT/JP95/02559 filed Dec. 14, 1995.

1. Field of the Invention

The present invention relates to a method of stainproofing cellulose fibers and a stainproofed product.

2. Related Art

It has been known to use as a stainproofing agent a copolymer containing repeating units derived from a fluoroalkyl group-containing monomer and a monomer containing a hydrophilic group (e.g. Japanese Patent Kokoku Publication No. 35033/1977, Japanese Patent Kokai Publication No. 68006/1992 and U.S. Pat. No. 3,574,791).

A known stainproofing agent is effective for a synthetic fiber (e.g. polyester, nylon, etc.) or a mixed textile of a synthetic fiber and a cellulose fiber (e.g. cotton, etc.), but a satisfactory performance can not be obtained when only the cellulose fiber is treated. The cellulose fiber and textile in the present specification include cotton, hemp, viscose rayon, cupro-ammonium rayon and wood pulp, and a cloth, a non-woven fabric and a sheet, produced by using these.

A method of improving stainproof properties by treating with a copolymer having a specific composition after pretreating a polyester by a melamine crosslinking is suggested, this method is not directed to the cellulose fibers (Japanese Patent Kokai Publication No. 277887/1990).

SUMMARY OF THE INVENTION

An object of the present invention is to provide a method for stainproofing a cellulose fiber itself, and a stainproofed product.

The above object is accomplished by a method of stainproofing a cellulose fiber, which comprises the steps of:

(1) esterifying a part of hydroxyl groups of the cellulose fiber in a heterogeneous reaction system; and then (2) treating the partially esterified cellulose fiber with a solution or emulsion of a copolymer containing repeating units derived from a fluroalkyl group-containing polymerizable compound and a compound represented by the general formula:

$$CH_2{=}CR^1COO{-}(XO)_m{-}(YO)_n{-}R^2 \quad (1)$$

wherein X is $-CH(CH_3)-CH_2-$ or $-CH_2-CH(CH_3)-$; Y is $-CH_2CH_2-$; $R^1$ is a hydrogen atom or a methyl group; $R^2$ is a hydrogen atom or an alkyl group having 1 to 8 carbon atoms; and each of m and n is an integer of 0 to 50, provided that m+n is an integer of 1 to 70.

The object of the present invention is also accomplished by a stainproofed product obtained by the above stainproofing method.

It has hitherto been difficult to impart stainproofing properties to the cellulose fiber, but it is possible to impart stainproof properties to the cellulose fiber by the method of the present invention.

DETAILED DESCRIPTION OF THE INVENTION

In the present invention, the moiety represented by XO and YO in the above formula (I) may be block or random.

In the method of the present invention, a part of hydroxyl groups of a cellulose fiber is esterified in a heterogeneous reaction system in the first step.

In this step, it is important to esterify the cellulose fiber while the intrinsic form of the cellulose fiber is maintained.

When a degree of esterification is represented by a degree of substitution (D.S.) defined below, it is preferably from 0.01 to 1.5, particularly from 0.03 to 1.3. When the degree of substitution is smaller than 0.01, the effect for imparting stainproof properties is poor. On the other hand, when it is larger than 1.5, intrinsic characteristics of the cellulose fiber such as moisture absorption properties, feeling, etc. are deteriorated.

Degree of substitution (D.S.)=average value of the number of esterified hydroxyl groups per one glucose moiety As the compound used for esterification, a fatty acid having $C_{1-20}$ alkyl group or a derivative thereof are preferred, but an aromatic carboxylic acid such as benzoic acid or a derivative thereof can also be used. Examples of an esterifying agent include a carboxylic acid, a carboxylic anhydride, a carboxylic acid chloride and a ketene.

The esterification reaction can be conducted in a liquid phase by optionally using a solvent and/or a catalyst. However, it is important to select the system in which a formed cellulose ester does not dissolve, that is, to select the system so that the reaction is conducted with maintaining the fiber state.

When the esterification is conducted by using acetic acid having a comparatively low boiling point, or a derivative thereof, the reaction can also be conducted in a vapor phase.

As a catalyst for esterification, there can be used a conventional catalyst such as sulfuric acid, perchloric acid, methanesulfonic acid, aromatic sulfonic acid, zinc chloride, sodium hydroxide, pyridine and the like.

The reaction temperature for the esterification reaction is normally from room temperature to 120° C., preferably from room temperature to 80° C. The reaction time is selected so that the above degree of substitution is accomplished.

A copolymer used in the second step contains a repeating unit derived from a fluoroalkyl group-containing polymerizable compound, and a repeating unit derived from an unsaturated compound represented by the above general formula.

The fluoroalkyl group-containing polymerizable compound used in the present invention is represented, for example, by the formula:

$$Rf{-}A^1{-}OCO{-}CA^2{=}CH_2$$

wherein Rf is a fluoroalkyl group; $A^1$ is $-(CH_2)_1-$, $$-SO_2\overset{\overset{R}{|}}{N}-(CH_2)_l-, \quad -CONH-(CH_2)_l-,$$

$$-CH_2\overset{\overset{OH}{|}}{C}H-CH_2- \text{ or } -CH_2\overset{\overset{O-COCH_3}{|}}{C}H-CH_2-$$

(R is a hydrogen atom or an alkyl group having 1 to 4 carbon atoms, and I is from 1 to 10); and $A^2$ is a hydrogen atom or a methyl group. Rf is preferably a perfluoroalkyl group.

Preferred examples of the fluoroalkyl group-containing polymerizable compound include the followings:

$$CF_3(CF_2)_4CH_2OCOC(CH_3){=}CH_2,$$

$$CF_3(CF_2)_7(CH_2)_2OCOC(CH_3){=}CH_2,$$

$$CF_3(CF_2)_7(CH_2)_2OCOCH{=}CH_2,$$

$$(CF_3)_2CF(CF_2)_4(CH_2)_2OCOCH{=}CH_2,$$

$$CF_3(CF_2)_7SO_2N(C_3H_7)(CH_2)_2OCOCH{=}CH_2,$$

-continued $CF_3(CF_2)_7(CH_2)_4OCOCH{=}CH_2$, $CF_3(CF_2)_7SO_2N(CH_3)(CH_2)_2OCOC(CH_3){=}CH_2$, $CF_3(CF_2)_7SO_2N(C_2H_4)(CH_2)_2OCOCH{=}CH_2$, $CF_3(CF_2)_7CONH(CH_2)_2OCOCH{=}CH_2$, $(CF_3)_2CF(CF_2)_4(CH_2)_3OCOCH{=}CH_2$, $(CF_3)_2CF(CF_2)_4CH_2CH(OCOCH_3)CH_2OCOC(CH_3){=}CH_2$, $(CF_3)_2CF(CF_2)_4CH_2CH(OH)CH_2OCOCH{=}CH_2$, $CF_3(CF_2)_9(CH_2)_2OCOCH{=}CH_2$, -continued $CF_3(CF_2)_9(CH_2)_2OCOC(CH_3){=}CH_2$, $CF_3(CF_2)_4CONH(CH_2)_2OCOC(CH_3){=}CH_2$,

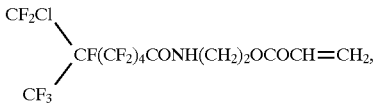

$H(CF_2)_{10}CH_2OCOCH{=}CH_2$, and $CF_2Cl(CF_2)_{10}CH_2OCOC(CH_3){=}CH_2$

As the compound represented by the above general formula (I) as the other component of the copolymer used in the present invention, a compound wherein each of n and m is 1 to 25 is preferred. These compounds may be used alone or in combination thereof.

The copolymer used in the present invention contains the fluoroalkyl group-containing polymerizable compound in an amount within the range usually from 5 to 95% by weight, preferably from 30 to 80% by weight, more preferably from 40 to 70% by weight, based on the total weight of the copolymer. When the amount of the fluoroalkyl group-containing polymerizable compound exceeds 95% by weight, the soil release property is insufficient. On the other hand, when the amount is smaller than 5% by weight, the oil repellency is insufficient.

An average molecular weight of the copolymer is normally from 1,000 to 1,000,000 (measured by a gel permeation chromatography (GPC)).

When the durability is particularly required, the copolymer may be copolymerized by adding a crosslinking monomer such as 3-chloro-2-hydroxypropyl (meth)acrylate, N-methylol (meth)acrylamide, diacetone (meth)acrylamide, glycidyl (meth)acrylate, glycerol mono(meth)acrylate, (meth)acrylic acid, isocyanate group-containing (meth) acrylate, blocked isocyanate-containing (meth)acrylate and the like. It is also possible to copolymerize (meth) acrylonitrile, vinyl chloride, vinylidene chloride, $C_1$–$C_{18}$ alkyl ester of acrylic acid or (meth)acrylic acid, styrene, benzyl (meth)acrylate, vinyl alkyl ketone, vinyl alkyl ether, isoprene, butadiene, chloroprene and the like.

These third monomers are used in an amount within the range usually from 0 to 40% by weight, preferably from 0 to 25% by weight, preferably from 0 to 15% by weight, based on the total weight of the copolymer.

Examples of the preferred combination of the monomers include a combination described in Example 1 of Japanese Patent Kokai Publication No. 116340/1994:

$CH_2{=}C(CH_3)COO(CH_2CH_2O)_9CH_3CH_2{=}C(CH_3)COO(CH_2CH(CH_3)O)_{12}H$/3-chloro-2-hydroxypropyl methacrylate/glycerol monomethacrylate, a combination described in Example 1 of Japanese Patent Kokoku Publication No. 35033/1977:

$CH_2{=}C(CH_3)COO(CH_2CH_2O)_9H/CH_2{=}C(CH_3)COO(CH_2CH_2O)_{4.5}H$/methacrylonitrile/$CH_2{=}C(CH_3)COOCH_2CH_2OH$;

a combination described in Example 1 of Japanese Patent Kokai Publication No. 68006/1992:

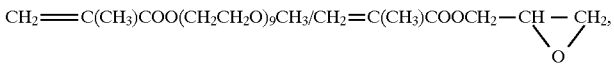

etc.

In order to further improve the water repellency and the oil repellency, a water- and oil-repellent (e.g. TG-521 (manufactured by Daikin Industries Ltd.)) can be mixed with the copolymer of the present invention in any proportion. In case of using the water- and oil-repellent, a weight ratio of the copolymer to the water- and oil-repellent active component is preferably from 10:0 to 10:50.

In order to obtain the copolymer of the present invention, various methods and conditions of the polymerization reaction can be optionally selected, and any of various polymerization methods such as a bulk polymerization, a solution polymerization, a suspension polymerization, an emulsion polymerization, and a radiation polymerization can be used. For example, there can be used a method which comprises emulsifying a mixture of copolymerizable compounds in water in the presence of a surfactant, and copolymerizing the mixture with stirring. As a polymerization initiator for the reaction system, various initiators such as a peroxide initiator, an azo initiator and a persulfuric acid initiator can be used. Since a polyalkylene glycol acrylate or methacrylate acts as a surfactant, it is not necessary to use the surfactant but various emulsifiers such as an anionic emulsifier, a cationic emulsifier and a nonionic emulsifier may be optionally used.

It is possible to perform a solution polymerization by an action of the polymerization initiator (e.g. a peroxide or azo compound which is soluble in the used organic solvent, or an ionizing radiation) after dissolving monomers in a suitable organic solvent. Examples of the solvent which is suitable for the solution polymerization include acetone, methyl ethyl ketone, isopropanol, ethylcellosolve, propylene glycol monomethyl ether, dipropylene glycol monomethyl ether, diglyme, triglyme and the like.

A stainproofing agent having any form such as an emulsion, a solvent solution, and an aerosol can be prepared from the obtained copolymer according to a conventional method.

A method of applying the stainproofing agent containing the copolymer as an active component may be appropriately selected according to the type of a treated material, the purpose of use and the form of the stainproofing agent. In case of the aqueous emulsion or solvent solution, it may be applied to the surface of a material to be treated by a known method such as a spray, a dipping and a coating, followed by drying. If necessary, a curing may be conducted. In case of the aerosol, it may only be sprayed to the material to be treated, followed by drying. Furthermore, antistatic agents, flame retardants, creaseproofing agents and other polymers may optionally be added to the copolymer of the present invention.

An amount of the copolymer to be applied to the cellulose fiber wherein a part of hydroxyl groups is esterified by the method of the present invention is usually from 0.1 to 10 parts by weight, based on 100 parts by weight of the treated material (cellulose fiber).

PREFERRED EMBODIMENT OF THE INVENTION

The present invention will be illustrated by Examples and Comparative Examples which do not limit the present invention. In the Examples and Comparative Examples, "%" is % by weight, unless otherwise stated.

(1) Water repellency and oil repellency

The water repellency and oil repellency shown in the following Examples and Comparative Examples were determined by the following test methods.

The water repellency is expressed by the water repellency No. (see Table 1) determined by the spray method according to JIS (Japanese Industrial Standard) L-1092. The oil repellency is determined by dropping 0.05 μL of a test solution shown in Table 2 on the surface of a test cloth and observing the penetration state of the drops after 30 seconds (AATCC-TM118-1983).

TABLE 1

| Water repellency No. | State |
|---|---|
| 100 | No wet on the surface |
| 90 | Slight wet on the surface |
| 80 | Partial wet on the surface |
| 70 | Wet on the surface |
| 50 | Wet over the whole surface |
| 0 | Complete wet on the front and back surfaces |

TABLE 2

| Oil repellency | Test solution | Surface tension (dyne/cm, 25° C.) |
|---|---|---|
| 8 | n-Heptane | 20.0 |
| 7 | n-Octane | 21.8 |
| 6 | n-Decane | 23.5 |
| 5 | n-Dodecane | 25.0 |
| 4 | n-Tetradecane | 26.7 |
| 3 | n-Hexadecane | 27.3 |
| 2 | n-Hexadecane/Nujol (35/65 by weight) | 29.6 |
| 1 | Nujol | 31.2 |
| 0 | Inferior to 1 | — |

(2) Soil release property (SR property)

The soil release property (SR property) is conducted as follows. A test cloth is spread on a filter paper laid horizontally and 0.1 μL of a dirty motor oil is dropped. After covering a polyethylene sheet thereon, a weight of 2 kg is put on the ployethylene sheet. After 60 seconds, the weight and the polyethylene sheet are removed. After standing at room temperature for 1 hour, the test cloth is washed with using 60 g of a detergent (Super Zabu: trade name) under the conditions of a bath volume of 35 liter and a liquid temperature of 40° C. for 10 minutes in an electric washing machine, rinsed and then air-dried. The state of the dried test cloth is expressed by a corresponding evaluation class shown in Table 3.

TABLE 3

| Evaluation class | Evaluation criteria |
|---|---|
| 1.0 | Remarkable stain remains |
| 2.0 | Considerable stain remains |
| 3.0 | Slight stain remains |
| 4.0 | Unnoticeable stain remains |
| 5.0 | No stain remains |

Examples of esterifying a part of hydroxyl groups of the cellulose fiber will be shown below.

Preparative Example 1 (acetylation in liquid phase)

Three cotton cloths (50 cm×50 cm) were put in a wide-mouthed bottle, and then 3 liter of a mixed solution of acetic anhydride/pyridine (20/80 vol./vol.) was poured into the bottle to entirely immerse the cotton cloths. After capping the bottle loosely with a glass stopper, the bottle was allowed to stand in a hot water at 60° C. for 8 hours.

After the completion of the reaction, the treated cloths were washed with water until the wash liquid does not exhibit acidity. Further the cloths were boiled for 30 minutes for stabilization. A content of bound acetic acid was measured according to a Frank Howlett's method [Journal of Textile Institute (J. Text. Inst.), 35 T1(1944)]. As a result, it was 9.2%. That is, the degree of substitution (DS) was 0.266.

The degree of substitution (DS) after acetylation was determined in the following manner.

When A is a content of bound acetic acid (%), the following equation is established.

$$A=(60\times DS\times 100)/(162+42DS)$$

This equation is modified to give the following equation.

$$\text{Degree of substitution (DS)}=(3.86\times A)/(142.9-A)$$

Preparative Example 2 (acetylation in vapor phase)

A cotton cloth (30 cm×30 cm) was immersed in 0.1N sulfuric acid at room temperature for 10 minutes, squeezed to a third to evaporate water until the water content was 50%, and then brought into contact with vapor of acetic anhydride in a desiccator at 20° C. for 10 hours. After the completion of the reaction, the degree of substitution was determined after treating according to the same manner as in Preparative Example 1. As a result, it was 0.247.

Preparative Example 3 (acetylation in vapor phase)

According to the same manner as in Preparative Example 2 except that an aqueous zinc sulfate solution (0.1 mol/L) was used in place of sulfuric acid and the time and the temperature for contacting with acetic anhydride vapor were changed to 3.5 hours and 60° C., respectively, the operation was conducted to obtain the acetylated cotton having degree of substitution of 0.78.

Preparative Example 4 (propionylation in liquid phase)

Ten cotton cloths (30 cm×30 cm) (100 g in total) were dried until the water content became 5%. The cotton cloths were immersed in 1.5 liter of propionic acid at room temperature for 10 hours. Then, these cotton cloths were squeezed until the total weight became 250 g. These pretreated cotton cloths were put at 40° C. in a mixture prepared by previously mixing 400 g of propionic acid, 50 g of zinc chloride and 400 g of propionic anhydride. The cotton cloths were removed after 20 minutes, put in a large amount of water, washed with water repeatedly and air-dried.

An amount of bonded propionic acid was determined in the following manner.

About 1 g of an air-dried esterified sample was dried over phosphorus pentaoxide in a vacuum desiccator, precisely weighed and charged in a 200 mL glass-stoppered Erlenmeyer flask. After adding 50 mL of a 0.5N methanolic potassium hydroxide solution, the mixture was saponified by allowing to stand at room temperature for 48 hours. Then, the amount of bonded propionic acid was determined after back titration with 0.5N hydrochloric acid.

The degree of substitution of the resulting propionylated cotton was 0.18.

Preparative Example 5 (palmitylation)

Twenty cotton cloths (about 160 g) (20 cm×30 cm) dried over phosphorus pentaoxide under a reduced pressure to give a constant weight were weighed. 320 g of pyridine and 2,500 mL of acetone were added to the cloths. Then, a solution of palmitoyl chloride ($C_{15}H_{31}COCl$, 980 g) in acetone (1600 ml) was added over 20 minutes and the mixture was reacted under reflux in a glass reaction vessel equipped with a reflux condenser for 90 minutes.

After cooling, the cotton cloths were washed three times with methanol and with acetone, alternately, and were extracted with acetone for 24 hours by a Soxhlet extractor. Acetone was removed to give a constant weight under a reduced pressure, and the cloths were precisely weighed. The degree of substitution determined by considering an increase in weight before and after the reaction to be caused by a palmitoyl esterification was 0.046.

Hereinafter, Preparative Examples of the stainproofing agent used in the second step will be shown.

Preparative Example 6

A compound (20 g) represented by $CF_3CF_2(CF_2CF_2)_nCH_2CH_2OCOC(CH_3)=CH_2$ (a mixture of compounds wherein n is 3, 4 and 5 in a weight ratio of 5:3:1), 10 g of $CH_2=C(CH_3)COO(CH_2CH_2O)_9CH_3$, 5 g of $CH_2=C(CH_3)COO(CH_2CH(CH_3)O)_{12}H$, 4 g of $CH_2=C(CH_3)COOCH_2CH(OH)CH_2Cl$, 1 g of $CH_2=C(CH_3)COOCH_2CH(OH)CH_2OH$ and 60 g of isopropanol were charged in a four-necked flask equipped with a mercury thermometer and a stirrer of a tetrafluoroethylene crescent-shaped stirrer, and then sufficiently emulsified by stirring under a nitrogen flow. After the atmosphere in the flask was sufficiently replaced by blowing nitrogen for about 1 hour, 0.1 g of azobisisobutyronitrile was charged and the copolymerization reaction was conducted at 70° C. with stirring for 10 hours. A gas chromatography analysis revealed that a conversion rate of the copolymerization reaction is not smaller than 97%. This conversion rate showed that the proportion of each repeating unit in the resulting copolymer is almost the same as that of the charged monomers. After the completion of the reaction, 40 g of isopropanol and 60 g of deionized water were charged to dilute the reaction liquid. The resulting copolymer liquid contained 19.5% by weight of a copolymer. A molecular weight of the copolymer was 12,000 (in terms of styrene) according to a gel permeation chromatography (GPC).

Preparative Example 7

A compound (70 g) represented by $CF_3CF_2(CF_2CF_2)_nCH_2CH_2OCOCH=CH_2$ (a mixture of compounds wherein n is 3, 4 and 5 in a weight ratio of 5:3:1), 25 g of $CH_2=C(CH_3)COO(CH_2CH_2O)_9CH_3$, 5 g of and

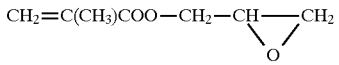

400 g of isopropanol were charged in a 1 liter four-necked flask equipped with a mercury thermometer and a stirrer of a tetrafluoroethylene crescent-shaped stirrer, and then sufficiently dispersed by stirring under a nitrogen flow. After the atmosphere in the flask was sufficiently replaced by blowing nitrogen for about 1 hour, 1.0 g of azobisisobutyronitrile was added and the copolymerization reaction was conducted under a nitrogen flow at 70° C. for 10 hours. A gas chromatography analysis revealed that a conversion rate of the copolymerization reaction is not smaller than 99%. This conversion rate showed that the proportion of each repeating unit in the resulting copolymer is almost the same as that of the charged monomers. The resulting copolymer dispersion contained 20% by weight of a copolymer solid.

Preparative Example 8

A compound (18 g) represented by $CF_3CF_2(CF_2CF_2)_nCH_2CH_2OCOC(CH_3)=CH_2$ (a mixture of compounds wherein n is 3, 4 and 5 in a weight ratio of 5:3:1), 10 g of $CH_2=C(CH_3)COO(CH_2CH_2O)_9CH_3$, 7 g of $CH_2=C(CH_3)COO(CH_2CH(CH_3)O)_9H$, 4 g of $CH_2=C(CH_3)COOCH_2CH(OH)CH_2Cl$, 1 g of $CH_2=C(CH_3)COOCH_2CH(OH)CH_2OH$, 70 g of deoxygenated high purity water, 80 g of isopropanol and 0.04 g of n-laurylmercaptane were charged in a four-necked glass flask equipped with a mercury thermometer and a stirrer of a tetrafluoroethylene crescent-shaped stirrer, and then sufficiently dispersed by stirring under a nitrogen flow. After nitrogen was blown through the flask for about 1 hour, a solution prepared by dissolving 0.4 g of azobisisobutylamidine hydrochloride in 10 g of water was added and the copolymerization reaction was conducted under a nitrogen flow at 60° C. for 10 hours. A gas chromatography analysis revealed that a conversion rate of the copolymerization reaction is not smaller than 99%. This conversion rate showed that the proportion of repeating units in the resulting copolymer is almost the same as that of the charged monomers. The resulting copolymer dispersion contained 20% by weight of a copolymer solid.

Preparative Example 9

$CF_3(CF_2)_7CH_2CH_2OCOCH=CH_2$ (60% by weight) (90 g), methacrylonitrile (12% by weight) (18 g), $CH_2=C(CH_3)COO(CH_2CH_2O_9H$ (15% by weight) (22.5 g), $CH_2=C(CH_3)COO(CH_2CH_2O)_{4.5}H$ (10% by weight) (15 g), hydroxyethyl methacrylate (3% by weight) (4.5 g), 450 g of deoxygenated deionized water, 100 g of acetone, 1.5 g of azobisisobutylamidine dihydrochloride and 10 g of

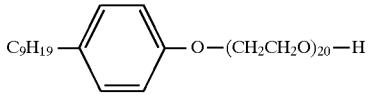

were charged in a four-necked glass flask equipped with a mercury thermometer and a stirrer of a tetrafluoroethylene crescent-shaped stirrer, and then sufficiently emulsified by stirring under a nitrogen flow. After nitrogen was blown through the flask for about 1 hour, the copolymerization reaction was conducted with slowly stirring at 60° C. for 20 hours. A gas chromatography analysis revealed that a conversion rate of the copolymerization reaction is not smaller than 99.6% (based on the fluoroalkyl group-containing polymerizable compound). The resulting stable emulsified latex contained 22.5% by weight of a copolymer solid.

Preparative Example 10

A monomer/emulsifier/water mixture of a compound (32.0 g) represented by $CF_3CF_2(CF_2CF_2)_nCH_2CH_2OOCCH{=}CH_2$ (a mixture of compounds wherein n is 3, 4 and 5 in a weight ratio of 5:3:1), 80 g of $CH_2{=}C(CH_3)COO[CH_2CH(CH_3)O]_7{-}(CH_2CH_2O)_9{-}C_8H_{17}$, 1.5 g of polyoxyethylene oleyl ether, 0.25 g of trimethylstearylammonium chloride, 10.0 g of ethyl acetate and 121.3 g of deionized water was emulsified by a high-pressure homogenizer. Then, 50 g of the resulting emulsion, 0.24 g of azobisisobutyronitrile and 0.12 g of tert-dodecylmercaptane were charged in a 100 ml glass ampul. After replacing the vapor phase by nitrogen, the copolymerization was conducted at 60° C. for 12 hours. The resulting emulsion was diluted with deionized water to adjust the solid content to 20.0%.

EXAMPLE 1

The copolymer dispersion prepared in Preparative Example 6 was diluted with water so that the copolymer solid content was 0.5% by weight. The acetylated cotton obtained in Preparative Example 1 was immersed in the diluted liquid and squeezed with a roll to adjust a wet pickup to 70%. Then, the acetylated cotton was dried at 100° C. for 3 minutes and treated at 160° C. for 1 minute.

With respect to the cloth thus treated, the water repellency was 7, the oil repellency was 7, and the soil release property was 5.

EXAMPLES 2 to 17

Except that the cloths treated in the first step of Examples 1 to 5 were treated with the copolymer dispersions prepared in Preparative Examples 6 to 10, the same manner as in Example 1 was repeated. The evaluation results are shown in Table 4.

Comparative Examples 1 to 5

Except that the cotton cloths which were not subjected to the treatment of the first step were treated with the copolymer dispersions prepared in Preparative Examples 6 to 10, the same manner as in Example 1 was repeated. The evaluation results are shown in Table 4.

TABLE 4

| | First step | Second step, copolymer | Water repellency No. | Oil repellency No. | Soil release property |
|---|---|---|---|---|---|
| Example 1 | Preparative Example 1 | Preparative Example 6 | 70 | 7 | 5 |
| Example 2 | Preparative Example 1 | Preparative Example 7 | 70 | 7 | 5 |
| Example 3 | Preparative Example 1 | Preparative Example 8 | 50 | 6 | 5 |

TABLE 4-continued

| | First step | Second step, copolymer | Water repellency No. | Oil repellency No. | Soil release property |
|---|---|---|---|---|---|
| Example 4 | Preparative Example 1 | Preparative Example 9 | 50 | 6 | 5 |
| Example 5 | Preparative Example 1 | Preparative Example 10 | 70 | 6 | 4 |
| Example 6 | Preparative Example 2 | Preparative Example 6 | 70 | 6 | 5 |
| Example 7 | Preparative Example 2 | Preparative Example 7 | 50 | 6 | 5 |
| Example 8 | Preparative Example 2 | Preparative Example 8 | 50 | 6 | 5 |
| Example 9 | Preparative Example 3 | Preparative Example 6 | 70 | 6 | 5 |
| Example 10 | Preparative Example 3 | Preparative Example 7 | 50 | 6 | 5 |
| Example 11 | Preparative Example 3 | Preparative Example 8 | 50 | 5 | 5 |
| Example 12 | Preparative Example 4 | Preparative Example 6 | 70 | 6 | 5 |
| Example 13 | Preparative Example 4 | Preparative Example 7 | 70 | 6 | 5 |
| Example 14 | Preparative Example 4 | Preparative Example 8 | 50 | 5 | 5 |
| Example 15 | Preparative Example 5 | Preparative Example 6 | 70 | 6 | 5 |
| Example 16 | Preparative Example 5 | Preparative Example 7 | 70 | 6 | 5 |
| Example 17 | Preparative Example 5 | Preparative Example 8 | 70 | 6 | 5 |
| Comparative Example 1 | — | Preparative Example 6 | 50 | 4 | 2 |
| Comparative Example 2 | — | Preparative Example 7 | 50 | 4 | 2 |
| Comparative Example 3 | — | Preparative Example 8 | 50 | 4 | 2 |
| Comparative Example 4 | — | Preparative Example 9 | 50 | 3 | 1 |
| Comparative Example 5 | — | Preparative Example 10 | 50 | 4 | 1 |

We claim:

1. A method of stainproofing a cellulose fiber, which comprises the steps of:

(1) esterifying a portion of the hydroxyl groups of the cellulose fiber in a heterogeneous reaction system such that the degree of esterification as represented by a degree of substitution is from 0.01 to 1.5; and then (2) treating the partially esterified cellulose fiber with a solution or emulsion of a copolymer having repeating units derived from a fluoroalkyl group-containing polymerizable compound and a compound represented by the general formula:

$$CH_2{=}CR^1COO{-}(XO)_m{-}(YO)_n{-}R^2 \quad (I)$$

wherein X is —CH ($CH_3$)—$CH_2$— or —$CH_2$CH ($CH_3$)—; Y is —$CH_2CH_2$—; $R^1$ is a hydrogen atom or a methyl group; $R^2$ is a hydrogen atom or an alkyl group having 1 to 8 carbon atoms; and each of m and n is an integer of 0 to 50, provided that the total of m and n is an integer of 1 to 70.

2. A cellulose textile obtained by esterifying a portion of the hydroxyl groups of the cellulose fiber in a heterogeneous reaction system such that the degree of esterification as represented by a degree of substitution is from 0.01 to 1.5 and then subjecting the partially esterified cellulose fiber to a stainproofing treatment with a solution or emulsion of a copolymer having repeating units derived from a fluoroalkyl group-containing polymerizable compound and a compound represented by the general formula:

$$CH_2{=}CR^1COO{-}(XO)_m{-}(YO)_n{-}R^2 \quad (I)$$

wherein X is —CH($CH_3$)—$CH_2$— or —$CH_2$CH($CH_3$)—; Y is —$CH_2CH_2$—; $R^1$ is a hydrogen atom or a methyl group; $R^2$ is a hydrogen atom or an alkyl group having 1 to 8 carbon atoms; and each of m and n is an integer of 0 to 50, provided that the total of m and n is an integer of 1 to 70.

3. The method according to claim 1, wherein the degree of esterification is from 0.03 to 1.3.

4. The cellulose textile according to claim 2, wherein the degree of esterification is from 0.03 to 1.3.

5. The method according to claim 1, comprising esterifying at room temperature to 120° C.

6. The method according to claim 5, comprising esterifying at room temperature to 80° C.

7. The method according to claim 1, wherein the fluoroalkyl group-containing polymerizable compound is represented by the formula:

$$Rf{-}A^1{-}OCO{-}CA^2{=}CH_2$$

wherein Rf is a fluoroalkyl group; $A^1$ is —$(CH_2)_l$—, $$-SO_2\overset{\overset{R}{|}}{N}-(CH_2)_l-,\quad -CONH-(CH_2)_l-,$$

$$-CH_2\overset{\overset{OH}{|}}{C}H-CH_2- \text{ or } -CH_2\overset{\overset{O-COCH_3}{|}}{C}H-CH_2-$$

R is a hydrogen atom or an alkyl group having 1 to 4 carbon atoms, and 1 is from 1 to 10; and $A^2$ is a hydrogen atom or a methyl group.

8. The cellulose textile according to claim 2, wherein wherein the fluoroalkyl group-containing polymerizable compound is represented by the formula:

$$Rf{-}A^1{-}OCO{-}CA^2{=}CH_2$$

wherein Rf is a fluoroalkyl group; $A^1$ is —$(CH_2)_l$—, $$-SO_2\overset{\overset{R}{|}}{N}-(CH_2)_l-,\quad -CONH-(CH_2)_l-,$$

-continued $$-CH_2\overset{\overset{OH}{|}}{C}H-CH_2- \text{ or } -CH_2\overset{\overset{O-COCH_3}{|}}{C}H-CH_2-$$

R is a hydrogen atom or an alkyl group having 1 to 4 carbon atoms, and 1 is from 1 to 10; and $A^2$ is a hydrogen atom or a methyl group.

9. The method according to claim 1, wherein the copolymer contains the fluoroalkyl group-containing polymerizable compound in an amount within a range of from 5 to 95% by weight based on the total weight of the copolymer.

10. The method according to claim 9, wherein the copolymer contains the fluoroalkyl group-containing polymerizable compound in an amount within a range of from 30 to 80% by weight based on the total weight of the copolymer.

11. The method according to claim 10, wherein the copolymer contains the fluoroalkyl group-containing polymerizable compound in an amount within a range of from 40 to 70% by weight based on the total weight of the copolymer.

12. The cellulose textile according to claim 2, wherein the copolymer contains the fluoroalkyl group-containing polymerizable compound in an amount within a range of from 5 to 95% by weight based on the total weight of the copolymer.

13. The cellulose textile according to claim 12, wherein the copolymer contains the fluoroalkyl group-containing polymerizable compound in an amount within a range of from 30 to 80% by weight based on the total weight of the copolymer.

14. The cellulose textile according to claim 13, wherein the copolymer contains the fluoroalkyl group-containing polymerizable compound in an amount within a range of from 40 to 70% by weight based on the total weight of the copolymer.

* * * * *